US012654809B2

(12) United States Patent
Rosseland

(10) Patent No.: US 12,654,809 B2
(45) Date of Patent: Jun. 16, 2026

(54) ANCHOR SYSTEMS AND METHODS

(71) Applicants: MHWIRTH AS, Kristiansand (NO); MHWIRTH GMBH, Erkelenz (DE)

(72) Inventor: Tom Egil Rosseland, Hoevag (NO)

(73) Assignees: MHWIRTH AS, Kristiansand S (NO); MHWIRTH GMBH, Erkelenz (DE)

( * ) Notice: Subject to any disclaimer, the term of this patent is extended or adjusted under 35 U.S.C. 154(b) by 475 days.

(21) Appl. No.: 18/037,323

(22) PCT Filed: Nov. 12, 2021

(86) PCT No.: PCT/NO2021/050237

§ 371 (c)(1),
(2) Date: May 17, 2023

(87) PCT Pub. No.: WO2022/108453

PCT Pub. Date: May 27, 2022

(65) Prior Publication Data

US 2023/0415853 A1 Dec. 28, 2023

(30) Foreign Application Priority Data

Nov. 19, 2020 (NO) ..... 20201260

(51) Int. Cl.
*B63B 21/26* (2006.01)
*B63B 21/48* (2006.01)
*B63B 21/50* (2006.01)

(52) U.S. Cl.
CPC ..... *B63B 21/26* (2013.01); *B63B 21/50* (2013.01); *B63B 21/48* (2013.01); *B63B 2021/505* (2013.01)

(58) Field of Classification Search
CPC ..... B63B 21/26; B63B 21/48; B63B 21/50; B63B 2021/505
See application file for complete search history.

(56) References Cited

U.S. PATENT DOCUMENTS 2,891,770 A * 6/1959 Bauer ..... E21B 7/128 175/7
2,988,893 A * 6/1961 Borrmann ..... E21B 7/12 405/226
3,163,238 A * 12/1964 Malott ..... E21B 7/12 175/7
3,330,338 A 7/1967 Dozier
3,621,910 A * 11/1971 Sanford ..... E21B 33/035 175/171
3,709,182 A * 1/1973 Horton ..... E21B 41/10 114/294
3,827,258 A 8/1974 Kammerer, Jr. et al.
3,984,991 A 10/1976 Kagler, Jr.
(Continued)

FOREIGN PATENT DOCUMENTS

DE 196 26 589 C1 2/1998
FR 1.548.477 12/1968
GB 1 526 934 10/1978

*Primary Examiner* — Amber R Anderson
*Assistant Examiner* — Stacy N Lawson
(74) *Attorney, Agent, or Firm* — Norman B. Thot

(57) ABSTRACT

A method for installing a sea floor anchor includes building a drill string from a vessel having a cementing hose, drilling a hole in the sea floor, lowering an anchor member from the vessel into the hole, and cementing the anchor member in place in the hole with the cementing hose.

14 Claims, 10 Drawing Sheets

(56) References Cited

U.S. PATENT DOCUMENTS

| | | | | |
|---|---|---|---|---|
| 4,039,025 | A * | 8/1977 | Burkhardt | E21B 41/08<br>166/290 |
| 2002/0081158 | A1 * | 6/2002 | Strong | E21B 7/20<br>405/232 |

* cited by examiner

ANCHOR SYSTEMS AND METHODS

CROSS REFERENCE TO PRIOR APPLICATIONS

This application is a U.S. National Phase application under 35 U.S.C. § 371 of International Application No. PCT/NO2021/050237, filed on Nov. 12, 2021 and which claims benefit to Norwegian Patent Application No. NO 20201260, filed on Nov. 19, 2020. The International Application was published in English on May 27, 2022 as WO 2022/108453 A1 under PCT Article 21(2).

FIELD

The present invention relates to anchor systems and methods, and in particular to methods and systems for establishing sea floor moored foundations from a vessel.

BACKGROUND

Mooring and anchoring systems are critical to provide a reliable station keeping of floating objects such as floating wind turbines or floaters used in petroleum production. Many solutions exist for this purpose, such as suction bucket moorings, embedded anchors, torpedo anchors, etc. With the increasing development of, for example, offshore renewable energy and the exploration of more remote and environmentally challenging areas for natural resources exploration, there exists a continuous need for improved mooring and anchoring technology. Improved mooring and anchoring technology is also relevant for various other offshore applications.

Documents which may be useful for understanding the field of technology of the present invention include U.S. Pat. No. 3,330,338 A, GB 1526934 A, U.S. Pat. Nos. 3,827,258 A, and 3,984,991 A.

SUMMARY

An aspect of the present disclosure is to provide improved technology for mooring and anchoring, or at least alternative solutions to the state of the art.

In an embodiment, the present invention provides a method for installing a sea floor anchor which includes building a drill string from a vessel which comprises a cementing hose, drilling a hole in a sea floor, lowering an anchor member from the vessel into the hole, and cementing the anchor member in place in the hole via the cementing hose from the vessel.

BRIEF DESCRIPTION OF THE DRAWINGS

The present invention is described in greater detail below on the basis of embodiments and of the drawings in which.

DETAILED DESCRIPTION

Figure 1:
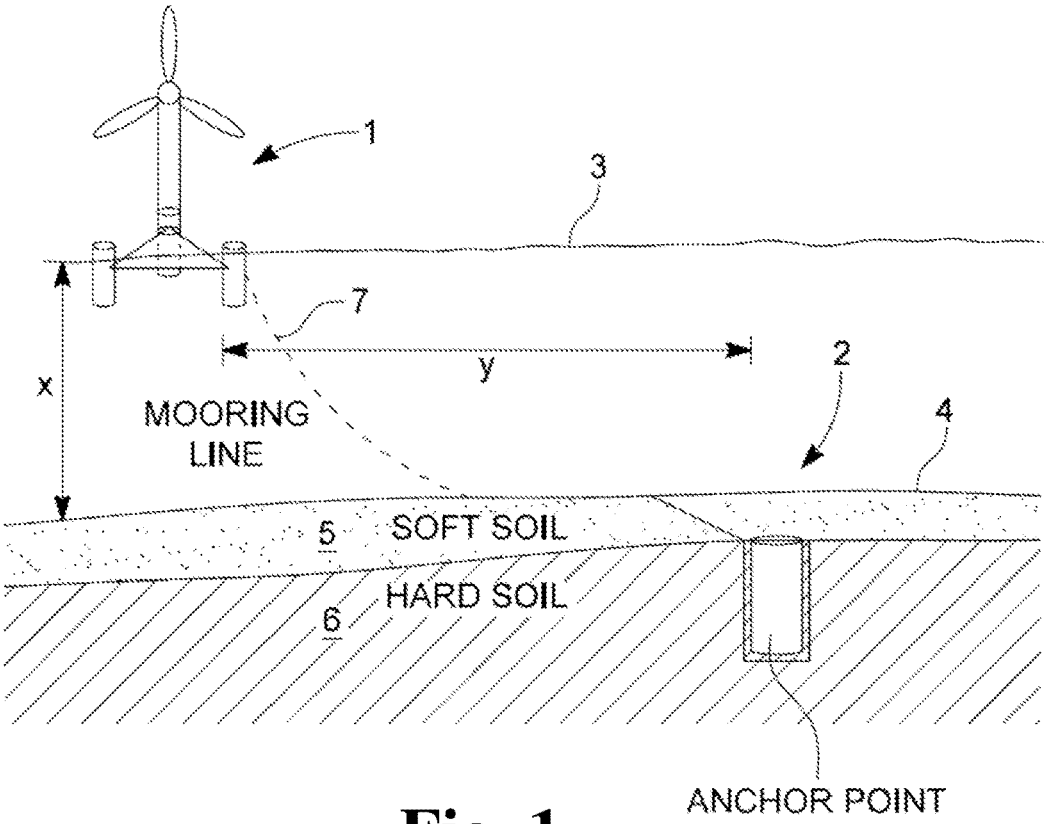
FIG. 1 illustrates an installation according to an embodiment of the present invention.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with a normal use of the present invention. The terms are used for the reader's convenience only and shall not be limiting.

Figure 2:
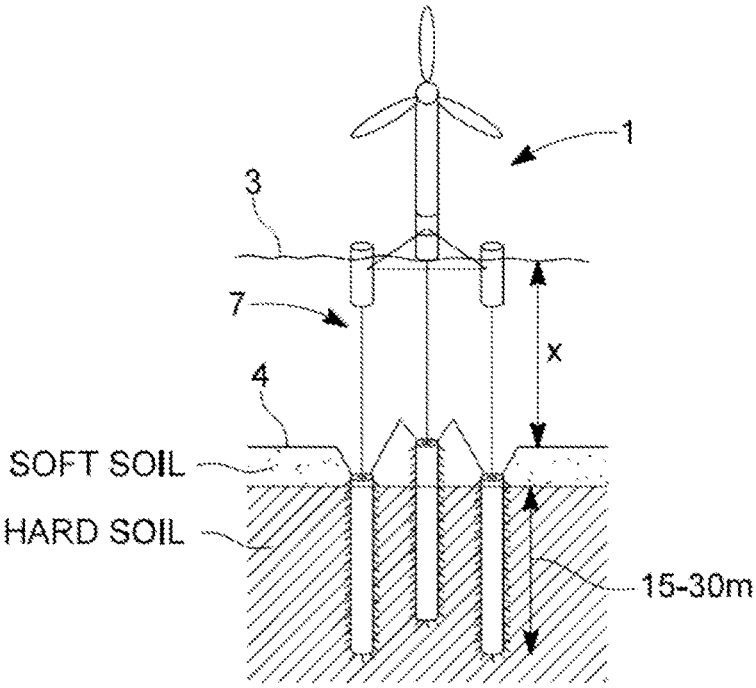
FIG. 2 illustrates an installation according to an embodiment of the present invention.

FIGS. 1 and 2 illustrate an example installation which may utilize embodiments described below. A floating structure 1 is moored to a sea floor 4 by means of a plurality of anchors 2 (only one anchor 2 is shown in FIG. 1 but it is to be understood that further anchors will usually be present). Mooring lines 7 connect the floating structure 1 to the anchors 2. The floating structure 1 may, for example, be a floating wind power generator, as illustrated. The floating structure 1 is moored at a location with a water depth x (the vertical distance between a waterline 3 and the sea floor 4). As illustrated in FIG. 1, the anchor 2 may be installed at a horizontal distance y away from the floating structure 1 to provide a so-called catenary mooring. Alternatively, as illustrated in FIG. 2, the mooring lines 7 may extend substantially vertically to provide a vertical mooring system. The mooring system may, for example, comprise three anchors 2 and three mooring lines 7.

The sea floor 4 may comprise a soft soil layer 5 and a hard soil layer 6. The soft soil layer 5 may have a lower density or hardness compared to the hard soil layer 6. The soft soil layer 5 and the hard soil layer 6 may be combined make up a rock formation, or the sea floor 4 may comprise only a rock formation, only a soft soil layer 5, or only a hard soil layer 6.

According to an embodiment, the present invention provides a method for installing an anchor 2 in the sea floor 4, the method comprising the steps of:

(a) building a drill string 13 from a vessel 10, (b) drilling a hole 12 in the sea floor 4, (c) lowering an anchor member 14 from the vessel 10 and into the hole 12, and (d) cementing the anchor member 14 in place in the hole 12 via a cementing hose 15 from the vessel 10.

Figure 3:
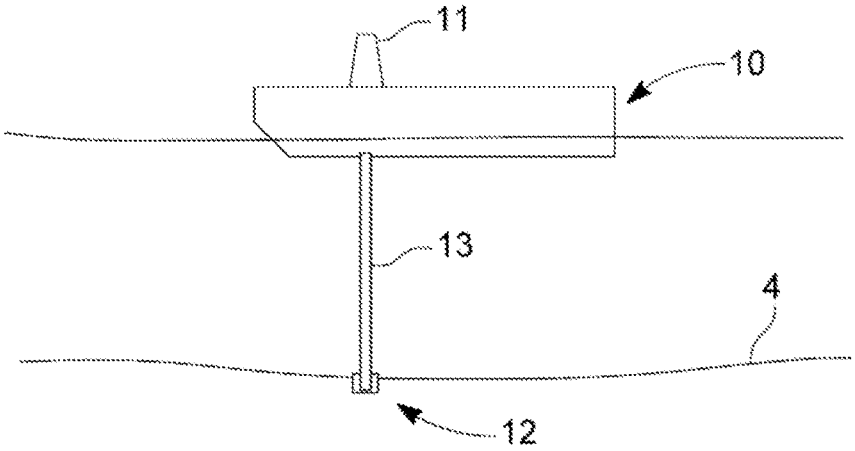
FIG. 3 illustrates steps of a method according to some embodiments, and in particular illustrates the drill string comprising a drilling head for engaging the sea floor and drilling a hole.

FIGS. 3-7 illustrate a method for installing an anchor 2 in the sea floor 4. A vessel 10 is provided and positioned above a location at which the anchor 2 is to be installed. A drill string 13 is built on the vessel 10, for example, by a plurality of individual drill string segments (for example, so-called joints or stands) connected together and lowered towards the sea floor 4. The drill string 13 comprises a drill string head 13' for engaging the sea floor 4 and for drilling a hole 12, as illustrated in FIG. 3.

When the hole 12 is completed, for example, after drilling the hole 12 to a depth of a few meter, the drill string 13 is lifted out of the hole 12 and may be hung off from the vessel 10 instead of being retrieved fully back onto the vessel 10. In such a case, the drill string 13 can remain hung off from the vessel 10 while carrying out steps (c) and (d). If using a vessel 10 having a moon pool 20 (see below), the drill string 13 may be hung off through the moon pool 20. The vessel 10 may be provided with a skidding arrangement or equivalent mechanism to allow the drill string 13 to be moved to the side or sideways within the moon pool 20 prior to carrying out steps (c) and (d). Moving or skidding the drill string 13 to the side may comprise moving or skidding the drill string 13 away from a vertical axis extending through the drilling machine 30 (described below). This may be performed, for example, via a trolley or skid arranged in or adjacent the moon pool 20. The drill string 13 may thereby, in a first position, be positioned vertically below the drilling machine 30 and, in a second position, be spaced from a vertical axis extending through the drilling machine 30.

The drilling (step (b)) may be carried out through the moon pool 20 of the vessel 10.

Figure 4:
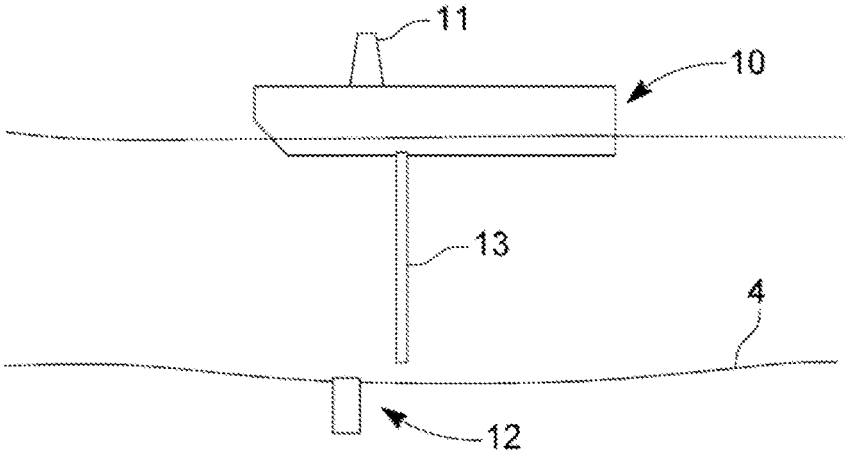
FIG. 4 illustrates steps of a method according to some embodiments, and in particular that, after the drilling of the hole has been completed, that the vessel may move slightly off the drilling position and/or the drill string may be skidded or moved away from the drilling position.
Figure 5:
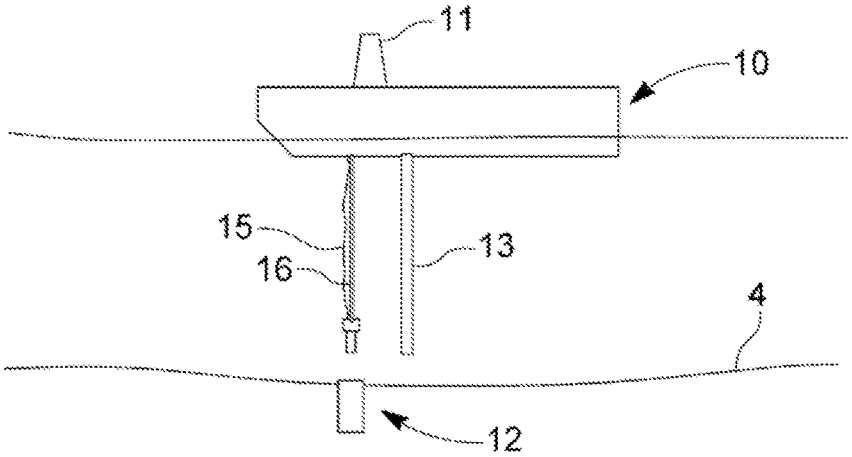
FIG. 5 illustrates steps of a method according to some embodiments, and in particular that the anchor member may be lowered via a winch and an elongate lifting member.
Figure 6:
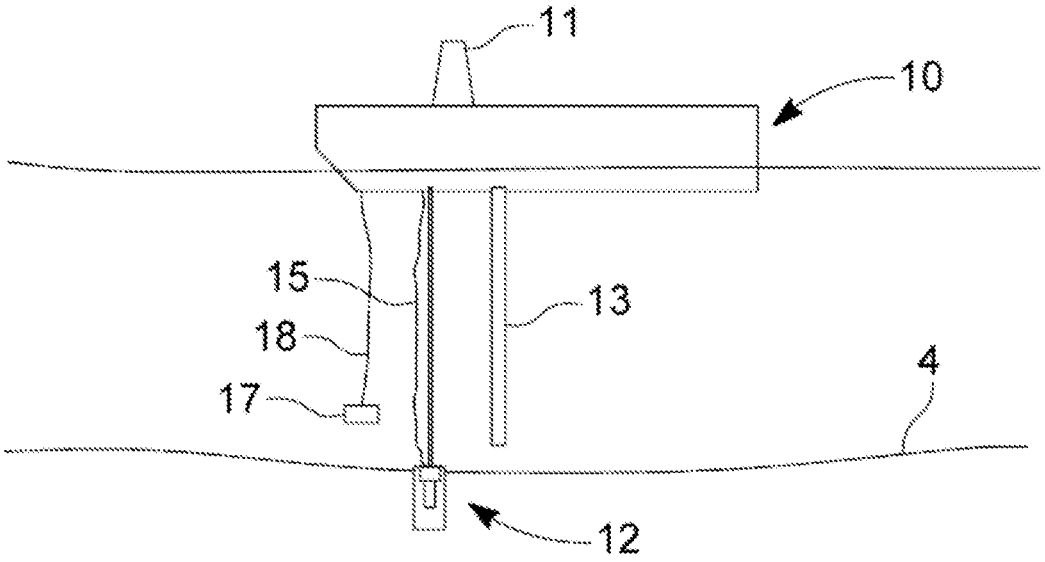
FIG. 6 illustrates steps of a method according to some embodiments, and in particular that the cementing hose may be handled by an ROV which is controlled via a control umbilical from the vessel.

As illustrated in FIG. 4, after the drilling of the hole 12 has been completed, the vessel 10 may move slightly off the drilling position and/or the drill string 13 may be skidded or moved away from the drilling position. As illustrated in FIGS. 5 and 6, an anchor member 14 is then lowered from the vessel 10 and into the hole 12. The anchor member 14 may be lowered via a winch and an elongate lifting member 16 (see FIG. 5), such as a rope or a wire. Supporting the anchor member 14 from the vessel 10 during the lowering may be done via a crane 31 (see FIGS. 11-14). The anchor member 14 may be lowered through a moon pool 20 of the vessel 10 or, optionally, over a side 41 of the vessel 10. If the lowering of the anchor member 14 is supported by the crane 31, the lifting member 16 may be a rope or a wire arranged on the crane 31 (such as on a winch drum on the crane 31), or it may be a rope or a wire arranged in connection with a separate winch on the vessel 10 and wherein the rope or wire is led via a sheave or the like held by the crane 31. If lowering the anchor member 14 over a side of the vessel 10, a cantilever structure 40 (see FIG. 19) may optionally be used for guidance or support.

FIGS. 5 and 6 also show that a cementing hose 15 may be lowered together with the anchor member 14 and fixed to the anchor member 14. The cementing hose 15 may be a tube or pipe which is operable to carry cement from the vessel 10 in order to fill voids between the anchor member 14 and the walls of the hole 12 so as to cement the anchor member 14 in place in the hole 12.

The cementing hose 15 can alternatively be provided separately from the anchor member 14, for example, in that the cementing hose 15 is lowered separately from the vessel 10.

The cementing hose 15 may be handled by an ROV 17 which is controlled via a control umbilical 18 from the vessel 10 (see FIG. 6).

After pumping cement into the hole 12, the cementing hose 15 can be detached from the anchor 2. This can, for example, be performed by the ROV 17. The ROV 17 may also, additionally or alternatively, detach the lifting member 16. The cementing hose 15 and/or the lifting member 16 may alternatively be detached, for example, via a release mechanism which activates by applying tension from the vessel 10, for example, via a sideways or vertical tension applied to the cementing hose 15 and/or the lifting member 16.

Figure 7:
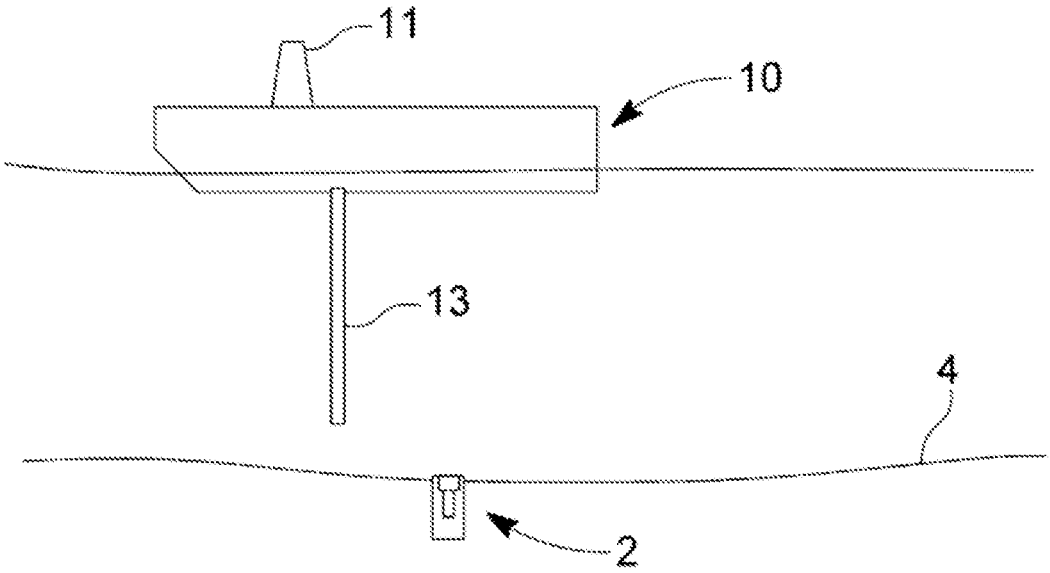
FIG. 7 illustrates steps of a method according to some embodiments, and in particular that the vessel may move to a new drilling location with the drill string hung off from the vessel.

After carrying out steps (a)-(d), the vessel 10 may move to a new drilling location. The vessel 10 may advantageously move to a new drilling location with the drill string 13 hung off from the vessel 10, as illustrated in FIG. 7. The anchor 2 has been installed and may be connected up to a floating object by another vessel, if necessary after a period of time to allow the cement to settle. The vessel 10 may optionally connect up the anchor 2 to a mooring line 7 or to a floating object before moving away.

Figure 8:
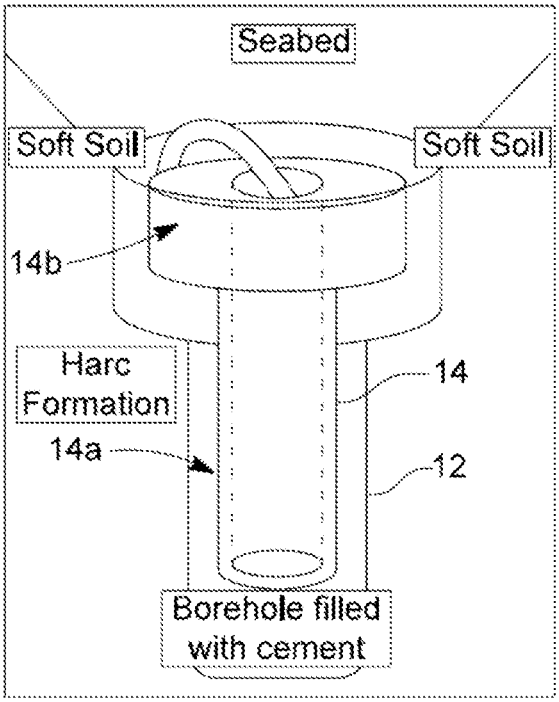
FIG. 8 illustrates an anchor of the present invention.

FIG. 8 illustrates an anchor member 14. The anchor member 14 can, for example, be cylindrical, and may have a varying cross-sectional diameter. The anchor member 14 may, for example, have a smaller diameter at a lower part **14*a* and larger diameter at an upper part 14*a*** thereof.

The hole 12 may advantageously be drilled with a diameter of more than 500 mm, more than 750 mm, more than 1000 mm, or more than 1250 mm.

The anchor member 14 may advantageously have a length of more than the diameter of the hole 12, more than 150% of the diameter of the hole 12, or more than 200% of the diameter of the hole 12.

Figure 9:
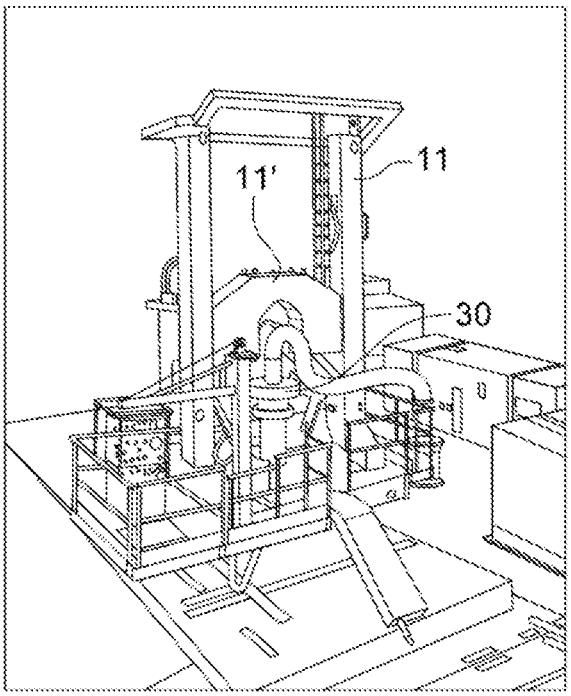
FIG. 9 illustrates a drilling machine and associated components suitable for use on a vessel.
Figure 10:
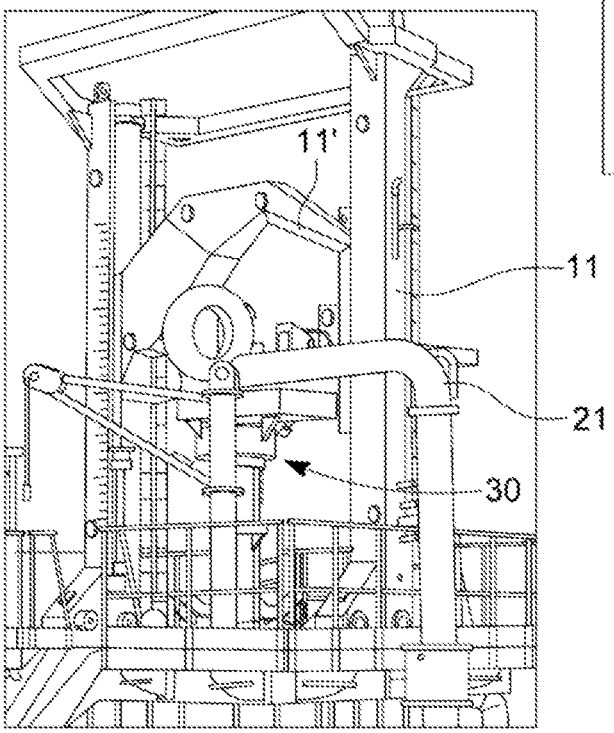
FIG. 10 illustrates a drilling machine and associated components suitable for use on a vessel.
Figure 11:
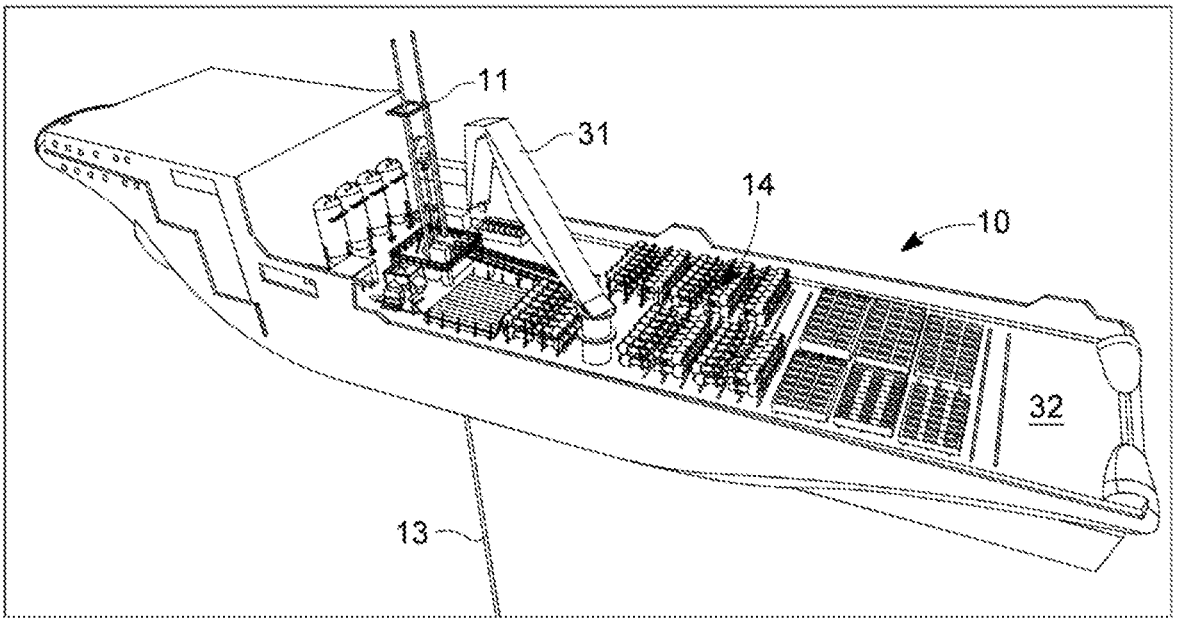
FIG. 11 illustrates a vessel for use with some embodiments of the present invention.
Figure 12:
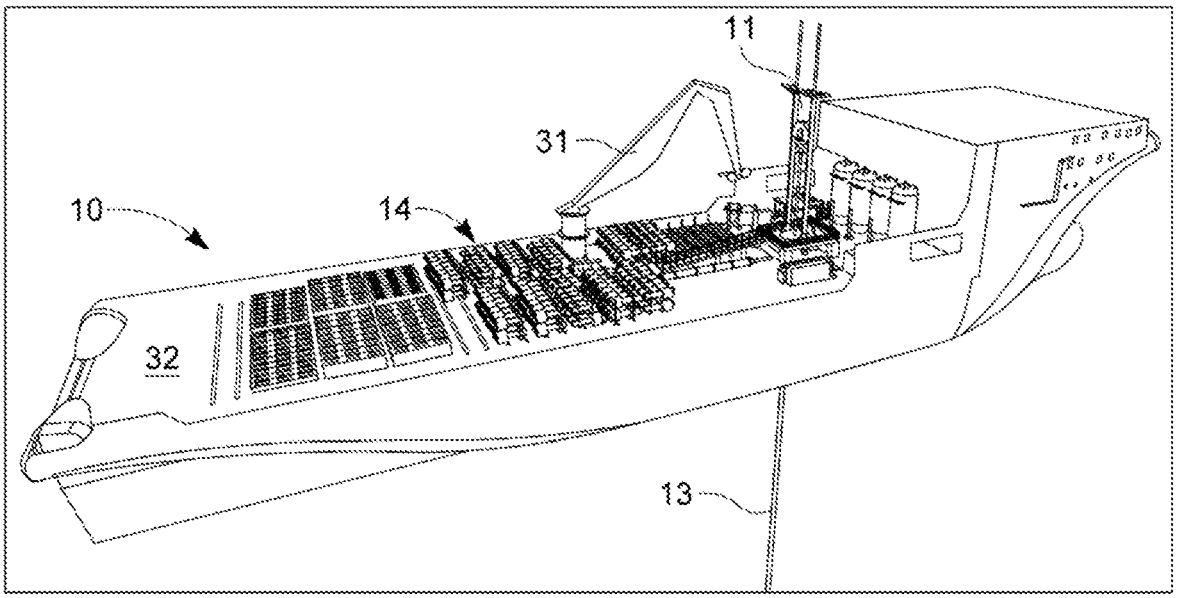
FIG. 12 illustrates a vessel for use with some embodiments of the present invention.
Figure 13:
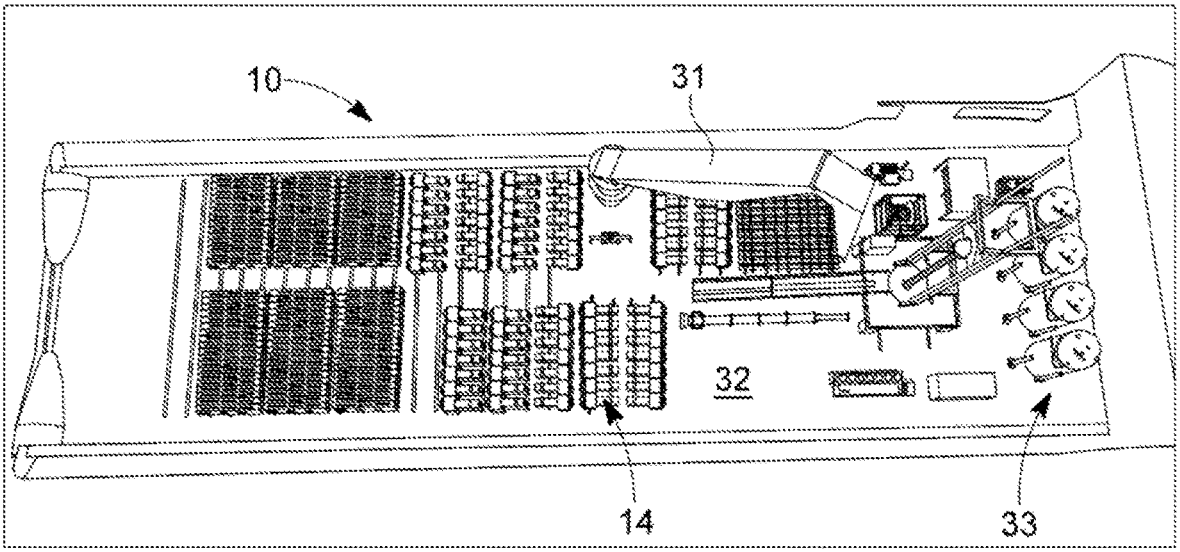
FIG. 13 illustrates a vessel for use with some embodiments where the vessel comprises a fluid handling system for handling of drilling fluid and/or cement.
Figure 14:
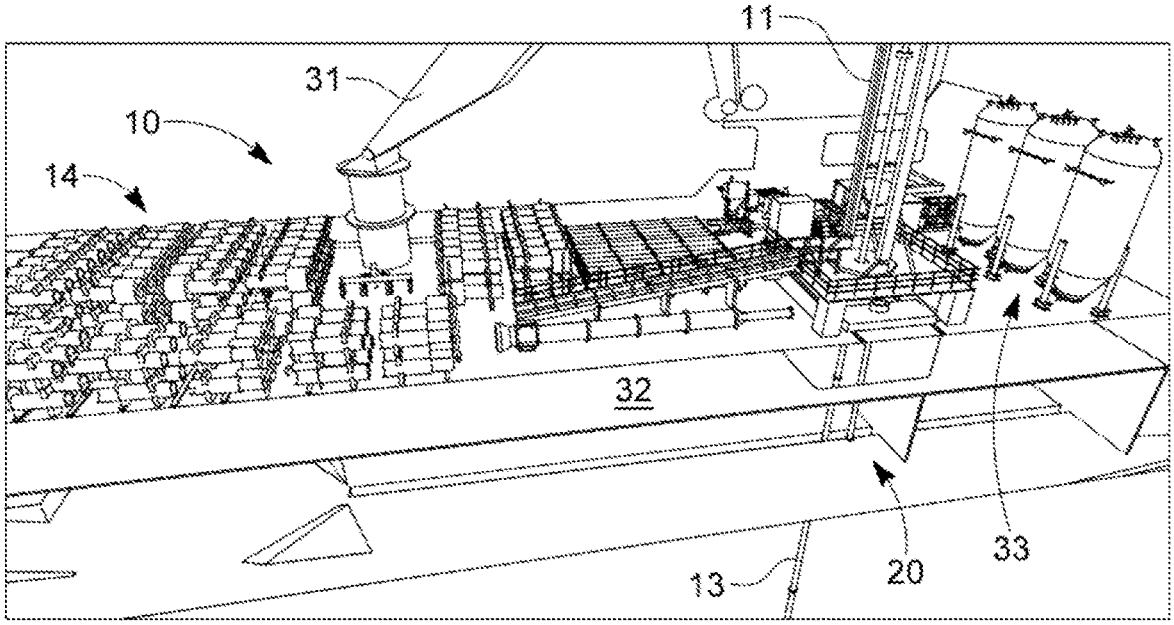
FIG. 14 illustrates a vessel for use with some embodiments where the vessel comprises a fluid handling system for handling of drilling fluid and/or cement.

FIGS. 9 and 10 illustrate a drilling machine 30 which is suitable for use on a vessel 10. The vessel 10 may have a support structure 11, such as a rig or tower structure, for holding the drilling machine 30. The drilling machine 30 and/or the support structure 11 may be positioned on a deck 32 of the vessel 10. The drilling machine 30 can be a drilling machine operable to rotate the drill string 13.

The drill string 13 is advantageously suspended from the vessel 10 from a heave compensated drilling machine 30. The drilling machine 30 is thereby heave compensated in the support structure 11.

The anchor member 14 is advantageously suspended from the vessel 10 from a heave compensated winch or crane 31. The winch or crane 31 may be independent of the drilling machine 30.

The drill string 13 may optionally be hung off from the vessel 10 as described above by leaving the drill string 13 hanging from the drilling machine 30 while operating the winch or crane 31 to carry out the steps relating to lowering and cementing the anchor member 14.

As described above, the sea floor may comprise a soft soil layer 5 (see FIGS. 1 and 2) and a hard soil layer 6, wherein the hard soil layer 6 is more compact than the soft soil layer 5. The method may comprise drilling into the hard soil layer 6 and cementing the anchor member 14 at least partly in the hard soil layer 6.

The method may comprise removing a part of the soft soil layer 5 prior to step (b). The soft layer 5 may be removed by drilling through the soft soil layer 5 prior to drilling into the hard soil layer 6. The vertical thickness of the soft soil layer 5 may be less than 5 m, less than 4 m, less than 3 m, or less than 2 m.

Any embodiments of the method described herein may comprise lowering a guide base with guide wires to the sea floor 4 and drilling through the guide base. The guide wires may also be used for quick access to the drilled hole when running and landing the anchor member.

FIGS. 11-14 illustrate a vessel 10 which may be suitable for carrying out a method according to embodiments described herein. The vessel 10 comprises components described above, including a support (rig or tower) structure 11 with a drilling machine 30 and a winch or crane 31, which in this example is a knuckle-boom crane 31. The vessel 10 has a moon pool 20 (see FIG. 14) in its hull, through which the drill string 13 and other components (such as wire/rope elongate lifting member 16) may be lowered.

The vessel 10 has a deck 32 on which associated components and equipment can be stored during operation. The vessel 10 may in particular have storage, on the deck 32 or elsewhere, for a plurality of anchor members 14 for installation. A large number of anchor members 14 may thereby be available and ready for installation on the vessel 10 so as to allow efficient operation.

The vessel 10 may also comprise fluid handling systems 33 (see FIGS. 13 and 14) for handling of drilling fluid and/or cement, as may be required during the abovementioned operations.

The anchors 2 can be designed for the expected soil conditions and operational conditions, for example, in view of their diameter, length, materials properties, etc. The anchors 2 may support one mooring line 7 (see FIGS. 1 and 2) or, optionally, more than one mooring line 7. In a wind park with a number of floating wind turbine generators, for example, one anchor 2 may provide support to more than one floating wind turbine generator, thereby reducing the total number of anchors 2 required.

If allowing for the drill string 13 to be hung off from the vessel 10, the drill string 13 may advantageously be built and tripped in once per location, and hung off in a parking position, for example, in the moon pool 20, while carrying out other activities. The other activities may be carried out by a crane or winch 31, or a combined crane and winch 31. When finished with such other activities, such as steps (c) and (d) described above, the vessel 10 may move to the next installation location and start the next drilling operation without having to build and trip in the entire drill string 13.

In any of the embodiments described here, the diameter of the hole 12 may, for example, be in the order of 1500 mm and the anchor member 14 may be in the order of 700-1300 mm for an anchor 2 suitable for use with a wind energy floater. Various other sizes may, however, be relevant for other applications, depending on the demands and requirements in any particular case.

Prior to commencing the drilling operation, an onboard ROV 17 may be deployed to inspect and, if required, measure inclination or other parameters of the sea floor 4.

Figure 15:
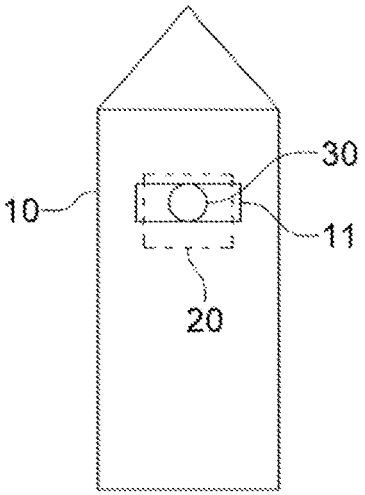
FIG. 15 illustrates the steps of a method where a structure is tilted or skidded, in particular to skid or tilt the drilling machine and associated components away from the moon pool area.
Figure 16:
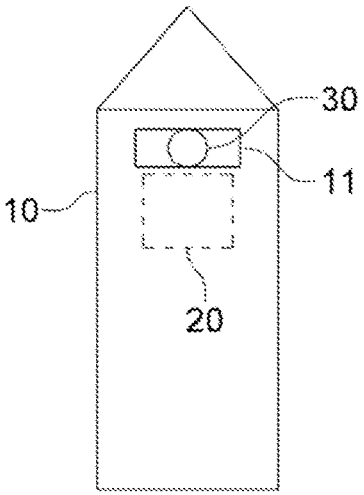
FIG. 16 illustrates the steps of a method where a structure is tilted or skidded, in particular to skid or tilt the drilling machine and associated components away from the moon pool area.

The vessel 10 may optionally have the functionality to skid or tilt the drilling machine 30 and associated components away from an area of the moon pool 20. This is illustrated in FIGS. 15 and 16 (see also FIGS. 9-14). The drilling machine 30 may be arranged supported by a support structure 11 which is movable in relation to the rest of the vessel 10 structure. The support structure 11 may, for example, be skiddable or tiltable in relation to the moon pool 20.

This is illustrated in FIGS. 15 and 16, wherein the support structure 11 with the drilling machine 30 can be skidded in relation to the moon pool 20. The support structure 11 may be skidded completely away from an opening defined by the moon pool 20, as illustrated in FIG. 16, or only partially away from the opening. If the drill string 13 remains suspended from the drilling machine 30 during, for example, the lowering of the anchor member 14, the support structure 11 may be skidded only sufficiently far to provide more space for other operations through the moon pool 20, but so that the drill string 13 may remain suspended from the drilling machine 30, through the moon pool 20, and into the water below the vessel 10.

Figure 17:
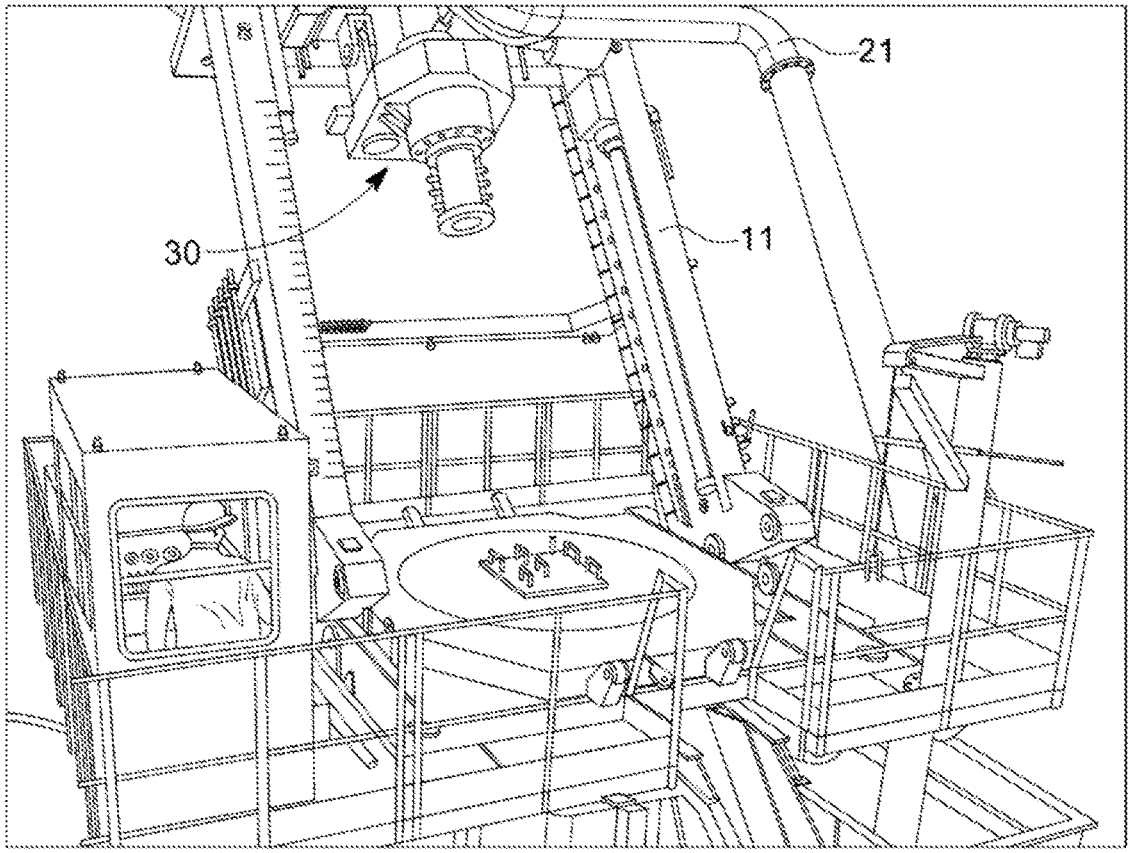
FIG. 17 illustrates how the support structure or a part of the support structure can be tilted in order to provide more space above the moon pool area.

FIG. 17 illustrates how the support structure 11 or a part of the support structure 11 can be tilted in order to provide more space above the area of the moon pool 20. The entire platform as shown in FIG. 17 can optionally or additionally be arranged with capability to be skidded sideways, similar to that illustrated in FIGS. 15 and 16.

Step (b) of the method may thus comprise operating a drilling machine 30 to drill the hole 12 in the sea floor 4, as described above, and thereafter skidding or tilting a support structure 11 supporting the drilling machine 30. The support structure 11, the drilling machine 30, or other associated components, may thereby be moved out of the way in order to facilitate other operations through the moon pool 20.

Figure 18:
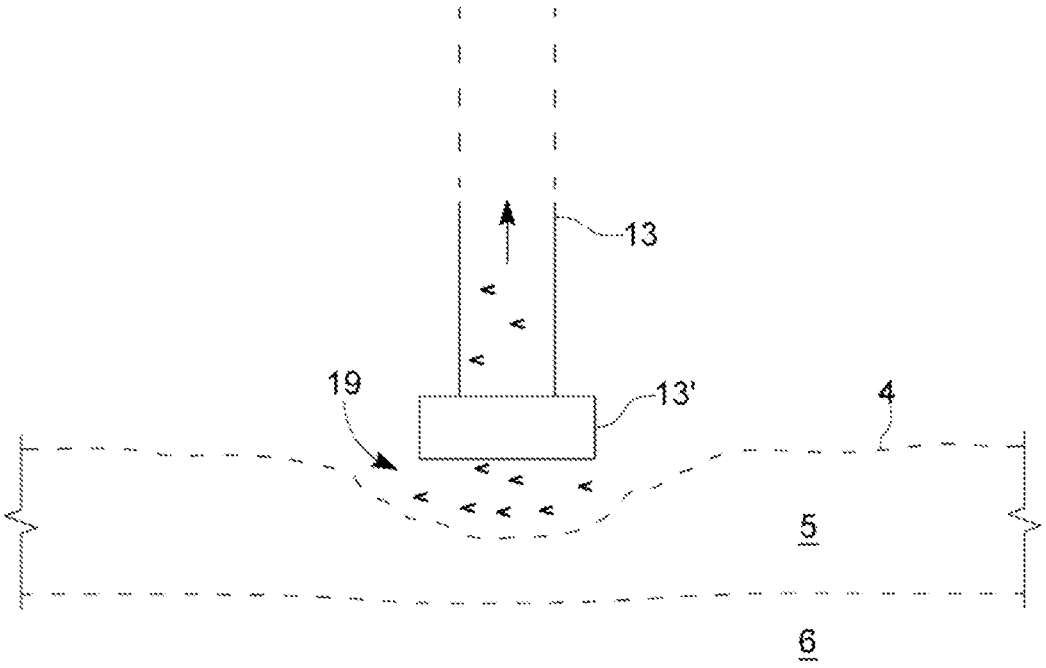
FIG. 18 illustrates steps of a method where a liquid flow is generated in a drill string.

As illustrated in FIG. 18, the method may comprise creating a liquid flow from a drill string head 13' and upwardly inside the drill string 13 to the vessel 10. In this embodiment, the method may include receiving soil particles or cuttings 19 on the vessel 10 via the liquid flow. The soil particles or cuttings 19 may be received on the vessel 10 for storage, processing, or transport away. The soil particles or cuttings 19 therefore need not be dumped on the sea floor 4.

Carrying out the drilling as a reverse circulation drilling (RCD) process provides the advantage that soil particles or cuttings 19 can be transported away from the site at or around the hole 12.

The liquid flow in the drill string 13 may, for example, be created by gas lift, i.e., by injecting gas (such as air) into the drill string 13. The liquid flow, including soil particles or cuttings 19, if present, may be received via a return pipe 21 arranged in association with the drilling machine 30, as can be seen in FIGS. 9 and 10. The return pipe 21 may be connected to a liquid handling system, for example, for separating liquid and soil particles or cuttings 19, other processing of the liquid, or discharge of the liquid.

A part of the soft layer 5 can advantageously be removed at an area of the sea floor 4 which is larger than a cross-section area of the drill string head 13' or is larger than a cross-section area of the drill string 13. This is indicated in FIG. 18, wherein a reverse circulation flow may be used to remove soil particles 19 from the soft soil layer 5 over a larger area than the cross-sectional area required for the hole 12. This provides the advantage that the hole 12 may have less risk of collapsing or that the risk of operational disturbance is reduced.

The method may comprise positioning a lower end, such as a drill string head 13', of the drill string 13 above and adjacent the soft soil layer 5 or into the soft soil layer 5 while suspending the drill string 13 from the vessel 10 and creating a liquid flow upwardly inside the drill string 13 to the vessel 10. In this embodiment, one may, for example, hover the lower end above the soft soil layer 5 while moving the vessel 10 in order that a larger area of the soft soil layer 5 is removed and transported to the vessel 10 via the liquid flow in the drill string 13.

As can be seen in, for example, FIGS. 9 and 10, the drilling machine 30 can be supported by a support structure 11 on the vessel 10. The support structure 11 can provide rotational support to the drilling machine 30 in a horizontal plane when the drilling machine 30 imposes a moment on the drill string 13 for rotating the drill string 13, and thus hold the drilling machine 30 rotationally fixed in relation to the vessel 10. The support structure 11 advantageously comprises a heave compensated frame 11' supporting the drilling machine 30. The heave compensated frame 11' may, for example, comprise vertically arranged hydraulic cylinders which allows for vertical motion of the drilling machine 30 in response to vessel heave.

The drilling machine 30 may alternatively be suspended by a heave compensated crane 31 (see FIGS. 11-14). In such an arrangement, the crane 31 can be arranged to hold the drilling machine 30 vertically, for example, by suspending the drilling machine 30 from the crane 31 via a hook or the like. The support structure 11 may be arranged to provide rotational support to the drilling machine 30, as described above, but to allow the drilling machine 30 to move freely in the vertical direction, for example, along tracks or support rods. A movable frame, similar to heave compensated frame 11', may be used for this purpose. The crane 31 may be operated in heave compensation mode to hold the drilling machine 30 in order to provide heave compensation capability of the drilling machine 30.

In any of the embodiments herein, the heave compensation may be a passive heave compensation or an active heave compensation.

Figure 19:
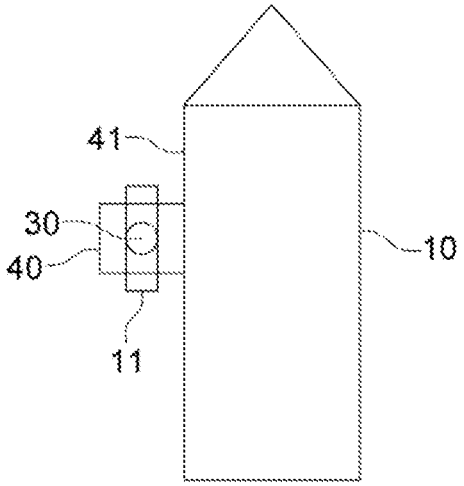
FIG. 19 illustrates a vessel having a side cantilever structure.

As illustrated in FIG. 19, in any of the embodiments described herein, the method may optionally be carried out over a side of the vessel via a cantilever structure 40 extending outwardly from a side 41 of the vessel 10. This may include building the drill string 13 from the cantilever structure 40, so that the drill string 13 is (directly or indirectly) suspended from the cantilever structure 40.

The anchor member 14 may additionally or alternatively be lowered from the vessel 10 via a cantilever structure 40, for example, by suspending the anchor member 14 directly or indirectly from the cantilever structure 40 while lowering it or by, for example, lateral support of the lifting member 16 while lowering it.

FIGS. 20-25 illustrate various embodiments of an anchor member 14 suitable for use with the method described herein. The anchor member 14 may have a suspension member 44, for example, a shackle or a hook, from which it can be suspended and lowered from the vessel 10 via the lifting member 16.

The anchor member 14 may advantageously have a perforated lower part **14*a*. This may allow cement to be distributed in and around the anchor member 14 in a manner beneficial for the anchor member 14 to be fixed reliably in the hole 12**.

Figure 20:
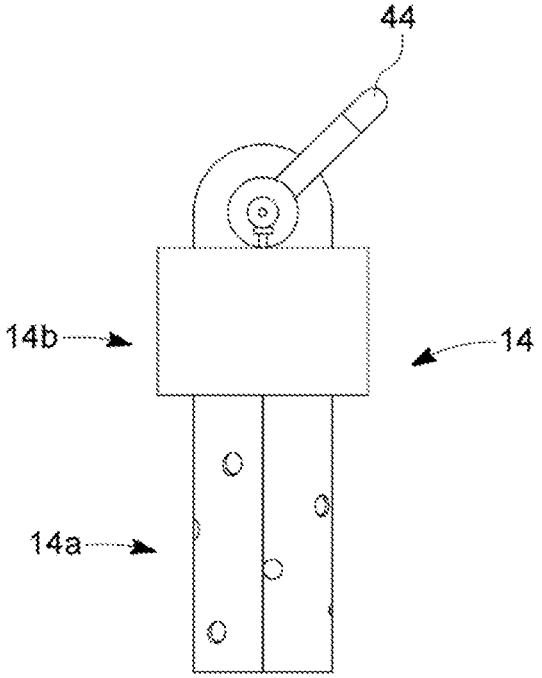
FIG. 20 illustrates an embodiment of an anchor member of the present invention where a lower part is formed as a hollow, elongate tube.
Figure 21:
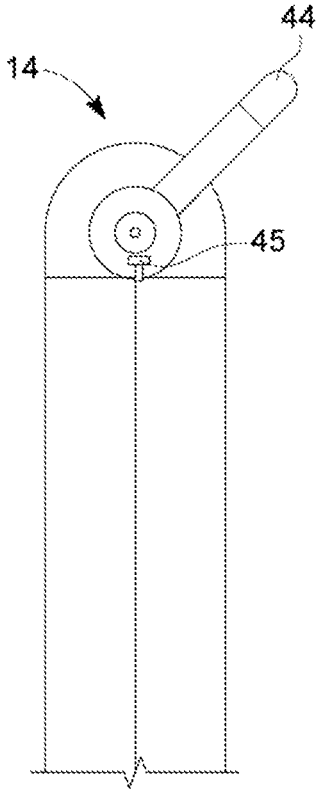
FIG. 21 illustrates an embodiment of an anchor member of the present invention.
Figure 22:
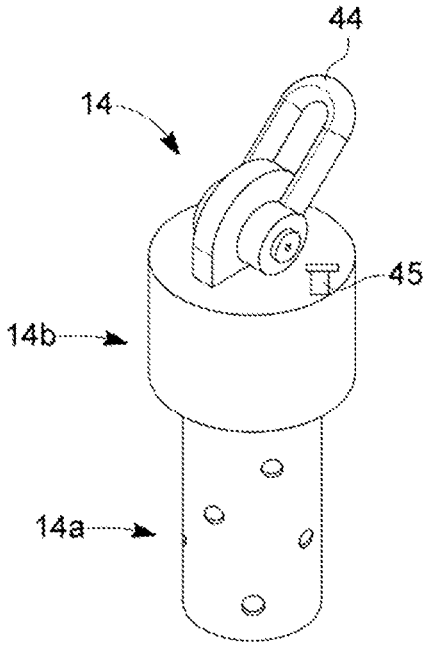
FIG. 22 illustrates an embodiment of an anchor member of the present invention where a lower part is formed as a hollow, elongate tube.
Figure 23:
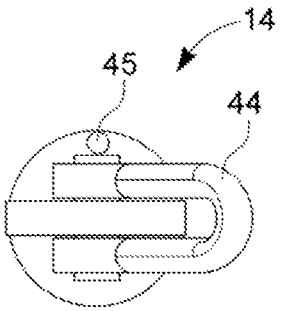
FIG. 23 illustrates an embodiment of an anchor member of the present invention.
Figure 24:
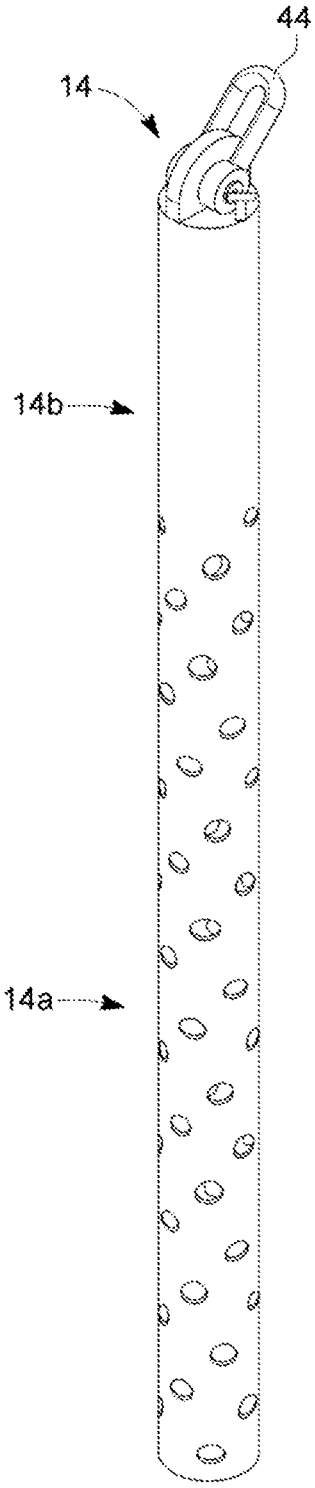
FIG. 24 illustrates an embodiment of an anchor member of the present invention where a lower part is formed as a hollow, elongate tube.
Figure 25:
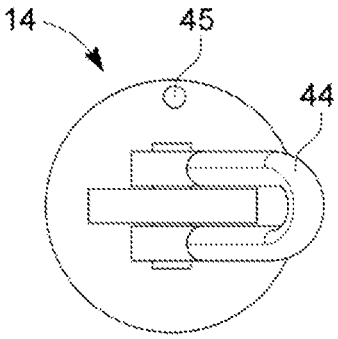
FIG. 25 illustrates an embodiment of an anchor member of the present invention.

The lower part **14*b* may be formed as a hollow, elongate tube, as shown, for example, in FIGS. 20, 22 and 24**.

The anchor member 14 may comprise an inlet tube probe 45 arranged for injection of cement into an internal part of the anchor member 14. The anchor member 14 may be arranged hollow for this purpose, for example, in an elongate cylindrical form, whereby an internal volume of the anchor member 14 may be filled with cement via the inlet tube probe 45. The inlet tube probe 45 may extend downwards inside the anchor member 14.

The cementing hose 15 may be connected to the inlet tube probe 45 before the anchor member 14 is lowered to the sea floor 4. The cementing hose 15 may alternatively be connected to the inlet tube probe 45 after lowering of the anchor member 14, for example, by assistance of an ROV 17. Cementing of the anchor member 14 may thereby be performed by filling cement into an inside volume of the anchor member 14 in addition to filling an annulus volume around the anchor member 14 in the hole 12. The anchor member 14 may optionally be cemented in place in the hole 12 by filling the annulus around the anchor member 14 in the hole 12 with cement.

If the inlet tube probe 45 extends into the interior volume of the anchor member 14, the method may comprise retracting the inlet tube probe 45 from inside the anchor member 14 during the cementing operation to achieve enhanced cement distribution, both inside the anchor member 14 and the annulus around the anchor member 14 by use of an onboard cement reel and assisted by ROV 17.

Figure 26:
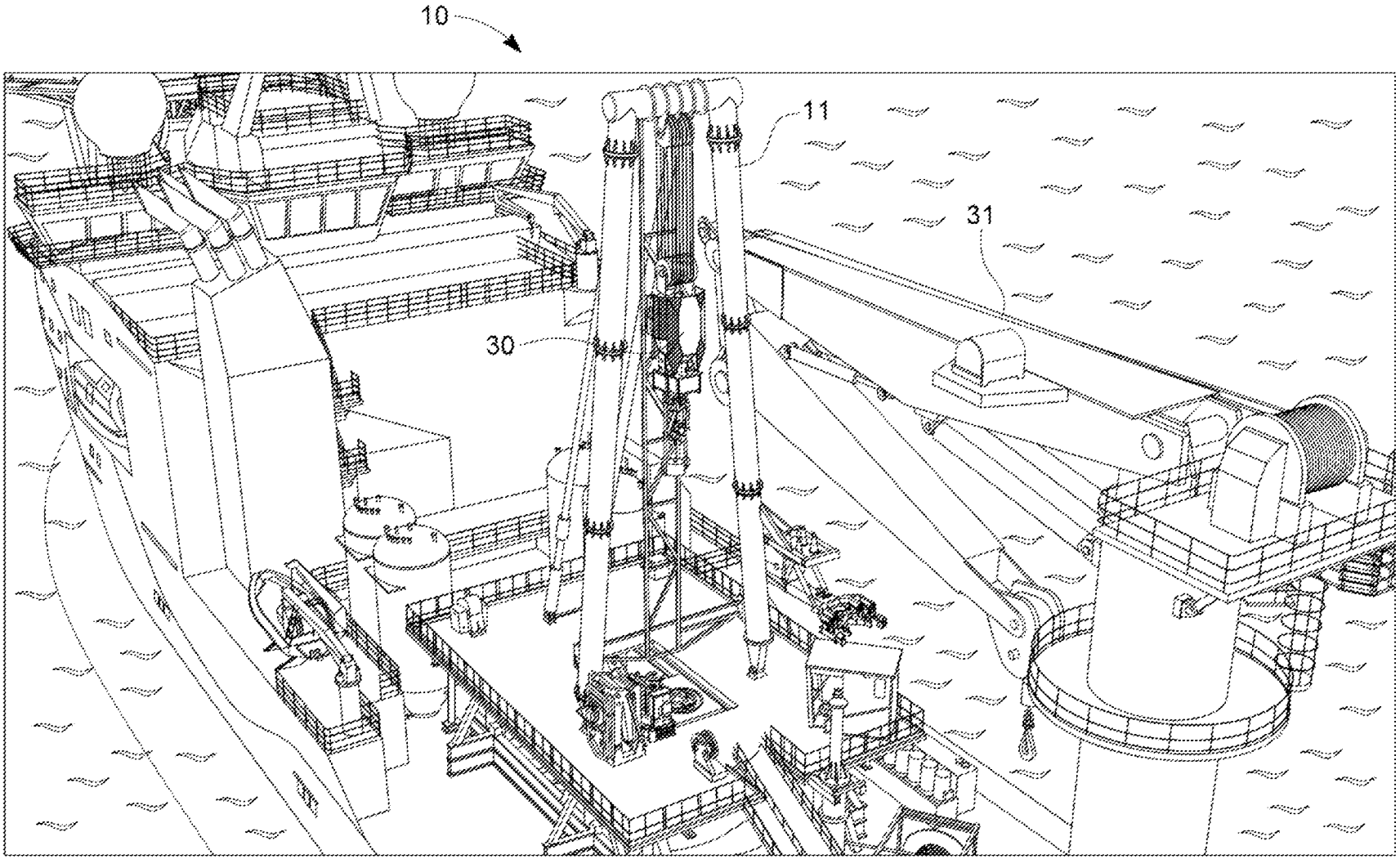
FIG. 26 illustrates a vessel for use with some embodiments of the present invention.

FIG. 26 illustrates an embodiment of a vessel 10 having an alternative support structure 11 for holding and suspending the drilling machine 30.

Embodiments described herein may, for example, be suitable for installation of floating renewable energy installations such as floating wind turbine units. According to embodiments, a more flexible installation of the mooring and anchoring systems can be achieved. A structurally reliable mooring in different or varying soil conditions can, for example, be obtained, and operations may be less sensitive to water depth. A high installation efficiency can additionally or alternatively be obtained, thereby allowing the use of less specialized installation vessels and/or reducing dependency on weather windows. This may be advantageous, for example, in the installation of large renewable energy parks, with a high number of mooring points required.

Advantageously, the vessel 10 may additionally be equipped for installing suction anchors. Having the possibility to carry out such "dual" operations can provide advantages of more efficient operations, for example, in areas with varying soil conditions, where a combination of suction anchors and cemented anchors may be used.

The system and method may be employed using lighter vessels than would normally be used for subsea drilling operations. Vessels known as offshore service vessels may, for example, be suitable for this purpose.

Further inventive aspects and embodiments according to the present invention are provided in the following numbered clauses:

1. A method for installing a sea floor anchor 2, the method comprising the steps of:
(a) building a drill string 13 from a vessel 10,
(b) drilling a hole 12 in the sea floor 4,
(c) lowering an anchor member 14 from the vessel 10 and into the hole 12, and
(d) cementing the anchor member 14 in place in the hole 12 via a cementing hose 15 from the vessel 10.
2. A method according to the preceding clause, wherein step (b) comprises drilling through a moon pool 20 of the vessel 10.
3. A method according to any preceding clause, wherein step (a) comprises building the drill string 13 from a cantilever structure 40 extending outwardly from a side 41 of the vessel 10.
4. A method according to any preceding clause, wherein step (c) comprises lowering the anchor member 14 through a moon pool 20 of the vessel 10.
5. A method according to any preceding clause, wherein step (c) comprises lowering the anchor member 14 from the vessel 10 over a side 41 of the vessel 10.
6. A method according to any preceding clause, wherein step (c) comprises lowering the anchor member 14 from the vessel 10 via a cantilever structure 40 extending outwardly from a side 41 of the vessel 10.
7. A method according to any preceding clause, the method comprising hanging off the drill string 13 from the vessel 10 while carrying out steps (c) and (d).
8. A method according to the preceding clause, wherein the step of hanging off the drill string 13 from the vessel 10 while carrying out steps (c) and (d) comprises hanging off the drill string 13 through the moon pool 20.
9. A method according to any preceding clause, method comprising skidding or otherwise moving the drill string 13 sideways prior to carrying out steps (c) and (d).
10. A method according to any preceding clause, the method comprising, after carrying out steps (a)-(d), moving the vessel 10 to a new drilling location with the drill string 13 hung off from the vessel 10.
11. A method according to any preceding clause, the method comprising lowering the anchor member 14 via a crane from the vessel 10.
12. A method according to any preceding clause, the method comprising lowering a guide base with guide wires to the sea floor 4 and drilling through the guide base.
13. A method according to any preceding clause, wherein step (c) comprises lowering the cementing hose 15 together with the anchor member 14 and fixed to the anchor member 14.
14. A method according to any preceding clause, the method comprising providing the cementing hose 15 separately from the anchor member 14, for example providing the cementing hose 15 by an ROV 17 controlled via a control umbilical 18 from the vessel 10.
15. A method according to any preceding clause, the method comprising, subsequent to step (d), detaching the cementing hose 15 from the anchor 2.
16. A method according to the preceding clause, wherein the step of detaching the cementing hose 15 form the anchor 2 comprises detaching the cementing hose 15 from the anchor 2 with an ROV 17.
17. A method according to any preceding clause, wherein the anchor member 14 is cylindrical.
18. A method according to any preceding clause, wherein the anchor member 14 has a circular cross-section with varying diameter.
19. A method according to the preceding clause, wherein the anchor member 14 has a smaller diameter at a lower part and larger diameter at an upper part.
20. A method according to any preceding clause, wherein step (b) comprises drilling the hole 12 with a diameter of more than 500 mm, more than 750 mm, more than 1000 mm or more than 1250 mm.
21. A method according to any preceding clause, wherein the anchor member 14 has a length of more than the diameter of the hole 12, more than 150% of the diameter of the hole 12, or more than 200% of the diameter of the hole 12.
22. A method according to any preceding clause, wherein step (b) comprises suspending the drill string 13 from the vessel 10 from a heave compensated drilling machine
23. A method according to any preceding clause, wherein the drilling machine 30 is supported by a support structure 11 on the vessel 10.
24. A method according to any preceding clause, wherein the support structure 11 comprises a heave compensated frame supporting the drilling machine 30.
25. A method according to any preceding clause, wherein the drilling machine 30 is suspended by a heave compensated crane 31.
26. A method according to any preceding clause, wherein the support structure 11 provides rotational support to the drilling machine 30 in a horizontal plane.
27. A method according to any preceding clause, wherein step (c) comprises suspending the anchor member 14 from the vessel 10 from a winch or crane 31.
28. A method according to any preceding clause, wherein step (c) comprises suspending the anchor member 14 from the vessel 10 from a heave compensated winch or crane 31.
29. A method according to any preceding clause, wherein step (c) comprises suspending the anchor member 14 from the vessel 10 from a winch or crane 31 which is independent of the drilling machine 30.
30. A method according to any preceding clause, wherein the sea floor comprises a soft soil layer 5 and a hard soil layer 6, wherein the hard soil layer 6 is more compact than the soft soil layer 5, and the method comprises drilling into the hard soil layer 6 and cementing the anchor member 14 at least partly in the hard soil layer 6.
31. A method according to any preceding clause, wherein the method comprises removing a part of the soft soil layer 5 prior to step (b).

32. A method according to any preceding clause, wherein the method comprises drilling through the soft soil layer 5 prior to the step of drilling into the hard soil layer.
33. A method according to any preceding clause, wherein a vertical thickness of the soft soil layer 5 is less than 5 m, less than 4 m, less than 3 m or less than 2 m.
34. A method according to any preceding clause, wherein step (b) comprises operating a drilling machine 30 to drill the hole in the sea floor 4, and wherein the method comprises skidding or tilting a support structure 11 supporting the drilling machine 30 between step (b) and step (c).
35. A method according to any preceding clause, wherein step (b) comprises creating a liquid flow from a drill string head 13' and upwardly inside the drill string 13 to the vessel 10.
36. A method according to any preceding clause, comprising receiving soil particles or cuttings 19 on the vessel 10 via the liquid flow.
37. A method according to any preceding clause, wherein step (b) is carried out as a reverse circulation drilling (RCD) drilling process.
38. A method according to any preceding clause, wherein the method comprises removing a part of the soft layer 5 via the liquid flow from the drill string head 13' and upwardly inside the drill string 13 to the vessel 10.
39. A method according to any preceding clause, wherein a part of the soft layer 5 is removed at a sea floor area larger than a cross-section area of the drill string head 13' or larger than a cross-section area of the drill string 13.
40. A method according to any preceding clause, comprising positioning a lower end, such as a drill string head 13', of the drill string 13 above and adjacent the soft layer 5 or into the soft layer 5 while suspending the drill string 13 from the vessel 10 and creating a liquid flow upwardly inside the drill string 13 to the vessel 10.
41. A method according to any preceding clause, comprising hovering the lower end above the soft layer 5 while moving the vessel 10.

The invention is not limited by the embodiments described above; reference should be had to the appended claims.

LIST OF REFERENCE CHARACTERS

1 Floating structure
2 Anchor
3 Waterline
4 Sea floor
5 Soft soil layer
6 Hard soil layer
7 Mooring line
10 Vessel
11 Support structure
11' Heave compensated frame
12 Hole
13 Drill string
13' Drill string head
14 Anchor member
14*a* Lower part/Perforated lower part
14*b* Upper part
15 Cementing hose
16 Lifting member
17 ROV
18 Control umbilical
19 Soil particles/Cuttings
20 Moon pool
21 Return pipe
30 Drilling machine
31 Winch/Crane
32 Deck
33 Fluid handling system
40 Cantilever structure
41 Side (of the vessel)
44 Suspension member
45 Inlet tube probe
x Water depth
y Horizontal distance

What is claimed is:

1. A method for installing a sea floor anchor, the method comprising:
building a drill string from a vessel;
drilling a hole in a sea floor;
lowering an anchor member from the vessel into the hole;
cementing the anchor member in place in the hole via a cementing hose from the vessel; and
after cementing the anchor member in place in the hole via the cementing hose from the vessel, moving the vessel to a new drilling location with the drill string hung off from the vessel.

2. The method as recited in claim 1, wherein,
the vessel comprises a moon pool, and
the drilling of the hole in the sea floor comprises drilling through the moon pool of the vessel.

3. The method as recited in claim 2, wherein the lowering of the anchor member from the vessel into the hole comprises lowering the anchor member through the moon pool of the vessel.

4. The method as recited in claim 1, further comprising:
hanging off the drill string from the vessel while performing the drilling of the hole in the sea floor and while lowering the anchor member from the vessel into the hole.

5. The method as recited in claim 1, further comprising:
skidding or otherwise moving the drill string sideways prior to lowering the anchor member from the vessel into the hole and prior to cementing the anchor member in place in the hole via the cementing hose from the vessel.

6. The method as recited in claim 1, wherein the lowering of the anchor member from the vessel into the hole further comprises:
lowering the cementing hose together with the anchor member,
wherein,
the cementing hose is fixed to the anchor member.

7. The method as recited in claim 1, wherein the drilling of the hole in the sea floor further comprises:
drilling the hole with a diameter of more than 500 mm.

8. The method as recited in claim 1, wherein,
the vessel comprises a heave compensated drilling machine, and
the drilling of the hole in the sea floor further comprises:
suspending the drill string from the vessel from the heave compensated drilling machine.

9. The method as recited in claim 1, wherein the drilling of the hole in the sea floor further comprises:
creating a liquid flow from a drill string head of the drill string and upwardly inside the drill string to the vessel.

10. The method as recited in claim 9, further comprising:
receiving soil particles or cuttings on the vessel via the liquid flow.

11. A method for installing a sea floor anchor, the method comprising:

building a drill string from a vessel;

drilling a hole in a sea floor;

lowering an anchor member from the vessel into the hole;

cementing the anchor member in place in the hole via a cementing hose from the vessel; and skidding or otherwise moving the drill string sideways prior to lowering the anchor member from the vessel into the hole and prior to cementing the anchor member in place in the hole via the cementing hose from the vessel.

12. The method as recited in claim 11, wherein, the vessel comprises a moon pool, and the drilling of the hole in the sea floor comprises drilling through the moon pool of the vessel.

13. The method as recited in claim 12, wherein the lowering of the anchor member from the vessel into the hole comprises lowering the anchor member through the moon pool of the vessel.

14. The method as recited in claim 11, further comprising:

hanging off the drill string from the vessel while performing the drilling of the hole in the sea floor and while lowering the anchor member from the vessel into the hole.

* * * * *